US009080260B2

(12) United States Patent
Headinger et al.

(10) Patent No.: US 9,080,260 B2
(45) **Date of Patent: *Jul. 14, 2015**

(54) LOW SHRINKAGE, DYEABLE MPD-I YARN

(75) Inventors: Mark H Headinger, Midlothian, VA (US); Edgar N Rudisill, Midlothian, VA (US); David W Luckey, Richmond, VA (US)

(73) Assignee: E I DU PONT DE NEMOURS AND COMPANY, Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/171,603

(22) Filed: Jun. 29, 2011

(65) Prior Publication Data

US 2011/0257359 A1 Oct. 20, 2011

Related U.S. Application Data

(63) Continuation of application No. 12/004,332, filed on Dec. 19, 2007, now Pat. No. 7,998,575.

(51) Int. Cl.

| | |
|---|---|
| ***D01F 6/60*** | (2006.01) |
| ***D01D 5/04*** | (2006.01) |
| ***D01D 5/12*** | (2006.01) |
| ***D01D 5/16*** | (2006.01) |

(52) U.S. Cl.

CPC *D01F 6/605* (2013.01); *D01D 5/04* (2013.01); *D01D 5/12* (2013.01); *D01D 5/16* (2013.01); *Y10T 428/2913* (2015.01); *Y10T 428/2967* (2015.01)

(58) Field of Classification Search

CPC ..... D01F 6/605; D01F 6/60; D01F 6/58; D01F 6/00; C08G 69/00; D01D 5/04

USPC ..... 428/364, 357, 346; 264/184, 205, 208, 264/211.14

See application file for complete search history.

(56) References Cited

U.S. PATENT DOCUMENTS

| | | | | |
|---|---|---|---|---|
| 2,130,948 | A | | 9/1938 | Carothers |
| 2,210,161 | A | * | 8/1940 | Berne-Allen, Jr. ..... 264/37.13 |
| 3,068,188 | A | * | 12/1962 | Stephens et al. ..... 524/104 |
| 3,094,511 | A | * | 6/1963 | Hill, Jr. et al. ..... 528/337 |
| 3,133,138 | A | | 5/1964 | Alexander, Jr. |
| 3,287,324 | A | * | 11/1966 | Sweeny ..... 528/348 |
| 3,381,506 | A | | 5/1968 | Cram |
| 3,391,672 | A | | 7/1968 | Cram |
| 3,414,645 | A | | 12/1968 | Morgan, Jr. |
| 3,493,422 | A | | 2/1970 | Berry, Jr. |
| 3,506,990 | A | * | 4/1970 | Richardson et al. ..... 8/539 |
| 3,725,523 | A | | 4/1973 | Bowen |
| 3,765,195 | A | | 10/1973 | Wilson |
| 4,029,835 | A | * | 6/1977 | Iwata et al. ..... 428/212 |
| 4,668,234 | A | | 5/1987 | Vance et al. |
| 4,883,496 | A | | 11/1989 | Ghorashi |
| 5,667,743 | A | | 9/1997 | Tai et al. |

(Continued)

*Primary Examiner* — Cheryl Juska

(74) *Attorney, Agent, or Firm* — Andrew G. Golian

(57) ABSTRACT

The invention relates a heat-treated poly(metaphenylene isophthalamide) polymer fiber having a crystalline structure as represented by a carbonyl stretch peak at a wavelength of 1,650 cm−1 in a Raman spectra response which before coloration with a dye, shrinks linearly 0.4 percent or less when exposed to 285 degrees Centigrade for 30 minutes; and which after contact with an aqueous red dye solution for 1 hour at 120 degrees Centigrade, has an "L" value coloration of at least 40 units lower than the "L" value of the fiber before coloration.

2 Claims, 10 Drawing Sheets

(56) References Cited

U.S. PATENT DOCUMENTS

| | | | | |
|---|---|---|---|---|
| 6,569,366 | B1 * | 5/2003 | Toyohara et al. | 264/48 |
| 6,569,987 | B1 * | 5/2003 | Ohba et al. | 528/310 |
| 7,771,636 | B2 * | 8/2010 | Headinger et al. | 264/205 |
| 7,771,637 | B2 * | 8/2010 | Headinger et al. | 264/205 |
| 7,771,638 | B2 * | 8/2010 | Headinger et al. | 264/205 |
| 7,780,889 | B2 * | 8/2010 | Headinger et al. | 264/205 |
| 2005/0093198 | A1 | 5/2005 | Rodini | |
| 2009/0160079 | A1 * | 6/2009 | Headinger et al. | 264/184 |
| 2009/0160080 | A1 * | 6/2009 | Headinger et al. | 264/184 |
| 2009/0160081 | A1 * | 6/2009 | Headinger et al. | 264/184 |
| 2009/0160082 | A1 * | 6/2009 | Headinger et al. | 264/205 |

* cited by examiner

LOW SHRINKAGE, DYEABLE MPD-I YARN

RELATED APPLICATION

The present patent application is a continuation of Ser. No. 12/004,332 filed Dec. 19, 2007 now U.S. Pat. No. 7,998,575.

FIELD OF THE INVENTION

The present invention relates to the production of meta-aramid and other high performance fibers.

BACKGROUND OF THE INVENTION

Meta-aramid polymers useful for spinning fiber can be obtained by the solution-based reaction of a diamine, such as metaphenylene diamine, with a diacid chloride, such as isophthaloyl chloride. This reaction produces hydrochloric acid as a by-product, which acid by-product can be neutralized by the addition of a basic compound to form a salt. Fibers are then spun from this solution of polymer, salt and solvent, and in so doing a good portion of the solvent is removed from the fiber during its initial formation. Subsequent steps are then employed to remove as much solvent from the fibers as possible and draw the fiber to develop improved fiber physical properties. Unfortunately, removal of the solvent from the fibers spun from the combination of polymer, solvent and salt is complicated by what is believed to be a chemical complex that forms between the salt and solvent in the fiber. It has been believed that long processing times were needed to allow adequate time for the mass transfer of the solvent from the fiber and to draw the fiber. Therefore the process for fiber manufacture has been physically separated or de-coupled into two isolated steps, one for spinning a fiber, operating at a high rate or speed; and a subsequent slow rate or speed washing and drawing process. Therefore what is needed is a method of rapid removal of the solvent from the fiber after spinning that would allow the coupling of the two processes together.

SUMMARY OF THE INVENTION

In one embodiment, the invention concerns a meta-aramid polymer fiber characterized as having improved thermal shrinkage and coloration. The fiber, before coloration with a dye, shrinks linearly 0.4 percent or less when exposed to 285 degrees Centigrade for 30 minutes. Additionally, the fiber, after being placed in contact with an aqueous red dye solution for 1 hour at 120 degrees Centigrade, has an "L" value coloration of at least 40 units lower than the "L" value of the fiber before coloration.

In another embodiment, the invention concerns a process for making the fiber by first extruding a solution through a shaped orifice into a gaseous medium. The solution comprises polymer, solvent, salt, and water. The gaseous medium evaporates at least 25% of the solvent in the fiber. The fiber is then quenched in an aqueous quenching solution having a first concentration of solvent, salt and water and at a first temperature. After the fiber is quenched, the fiber is then contacted with an aqueous conditioning solution at a second concentration of solvent, salt and water and at a second temperature. Once the fiber is conditioned, the fiber may then be drawn.

In other embodiments, the drawn fiber may be washed and dried, and thereafter, heat treated by heating the fiber above the glass transition temperature of the fiber.

BRIEF DESCRIPTION OF THE DRAWINGS

The summary, as well as the following detailed description, is further understood when read in conjunction with the appended drawings. For the purpose of illustrating the invention, there are shown in the drawings exemplary embodiments of the invention; however, the invention is not limited to the specific methods, compositions, and devices disclosed. In addition, the drawings are not necessarily drawn to scale. In the drawings.

DETAILED DESCRIPTION OF ILLUSTRATIVE EMBODIMENTS

Figure 1:
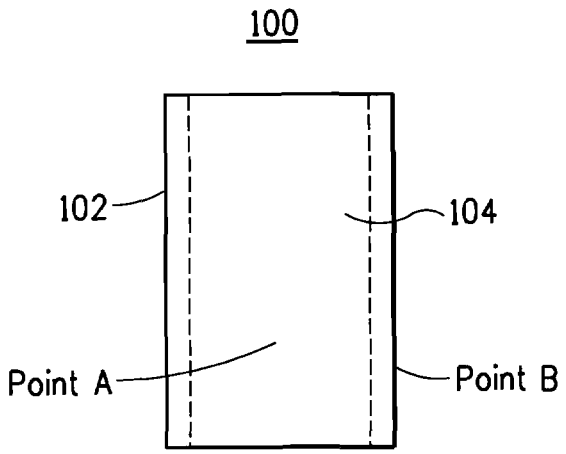
FIG. 1 shows a cross section of an extruded fiber illustrating an inner portion and an outer shell.
Figure 2:
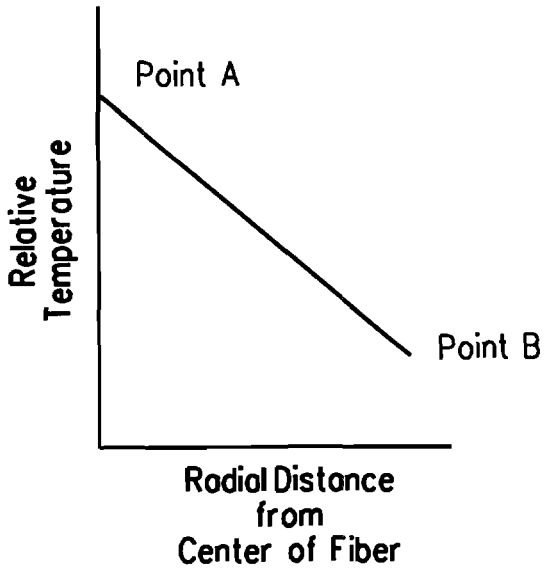
FIG. 2 shows a thermal diagram of a cross section of the extruded fiber of FIG. 1.

The present invention may be understood more readily by reference to the following detailed description taken in connection with the accompanying figures and examples, which form a part of this disclosure. It is to be understood that this invention is not limited to the specific devices, methods, applications, conditions or parameters described, shown, or both, herein, and that the terminology used herein is for the purpose of describing particular embodiments by way of example only and is not intended to be limiting of the claimed invention. Also, as used in the specification including the appended claims, the singular forms "a," "an," and "the" include the plural, and reference to a particular numerical value includes at least that particular value, unless the context clearly dictates otherwise. The term "plurality", as used herein, means more than one. When a range of values is expressed, another embodiment includes from the one particular value, or to the other particular value, or both. Similarly, when values are expressed as approximations, by use of the antecedent "about," it will be understood that the particular value forms another embodiment. All ranges are inclusive and combinable.

It is to be appreciated that certain features of the invention which are, for clarity, described herein in the context of separate embodiments, may also be provided in combination in a single embodiment. Conversely, various features of the invention that are, for brevity, described in the context of a single embodiment, may also be provided separately or in any subcombination. Further, reference to values stated in ranges includes each and every value within that range.

The term "dry spinning" means a process for making a filament by extruding a solution into a heated chamber having a gaseous atmosphere to remove a substantial portion of the solvent, leaving a solid or semi-solid filament having enough physical integrity that it can be further processed. The solution comprises a fiber-forming polymer in a solvent which is extruded in a continuous stream through one or more spinneret holes to form filaments. This is distinct from "wet spinning" or "air-gap wet spinning" (also known as air-gap spinning) wherein the polymer solution is extruded into a liquid precipitating or quenching medium to regenerate the polymer filaments. In other words, in dry spinning a gas is the primary initial solvent extraction medium, and in wet spinning a liquid is the primary initial solvent extraction medium. In dry spinning, after sufficient removal of solvent from the polymer and the formation of solid or semi-solid filaments, the filaments can then be treated with additional liquids to cool and further coagulate the filaments and subsequently wash the filaments to further extract remaining solvent.

The term "meta-aramid fiber" includes meta-oriented synthetic aromatic polyamide polymers. The polymers can include polyamide homopolymers, copolymers, or mixtures thereof which are predominantly aromatic, wherein at least 85% of the amide (—CONH—) linkages are attached directly to two aromatic rings. The rings can be unsubstituted or substituted. The polymers are meta-aramid when the two rings or radicals are meta oriented with respect to each other along the molecular chain. Preferably copolymers have no more than 10 percent of other diamines substituted for a primary diamine used in forming the polymer or no more than 10 percent of other diacid chlorides substituted for a primary diacid chloride used in forming the polymer. Additives can be used with the aramid; and it has been found that up to as much as 13 percent by weight of other polymeric material can be blended or bonded with the aramid.

The preferred meta-aramids are poly(meta-phenylene isophthalamide)(MPD-I) and its copolymers. One such meta-aramid fiber is Nomex® aramid fiber available from E. I. du Pont de Nemours and Company of Wilmington, Del., however, meta-aramid fibers are available in various styles under the trademarks Conex®, available from Teijin Ltd. of Tokyo, Japan; Apyeil®, available from Unitika, Ltd. of Osaka, Japan; New Star® Meta-aramid, available from Yantai Spandex Co. Ltd, of Shandong Province, China; and Chinfunex® Aramid 1313 available from Guangdong Charming Chemical Co. Ltd., of Xinhui in Guangdong, China. Meta-aramid fibers are inherently flame resistant and can be spun by dry or wet spinning using any number of processes; however, U.S. Pat. Nos. 3,063,966; 3,227,793; 3,287,324; 3,414,645; and 5,667,743 are illustrative of useful methods for making aramid fibers that could be used.

The term "fiber" means a relatively flexible, unit of matter having a high ratio of length to width across its cross-sectional area perpendicular to its length. Herein, the term "fiber" is used interchangeably with the term "filament" or "end". The cross section of the filaments described herein can be any shape, but are typically circular or bean shaped. Fiber spun onto a bobbin in a package is referred to as continuous fiber. Fiber can be cut into short lengths called staple fiber. Fiber can be cut into even smaller lengths called floc. Yarns, multifilament yarns or tows comprise a plurality of fibers. Yarn can be intertwined, twisted, or both.

The term "crystallized fiber" as used herein means a fiber that is thermally stable, that is, it does not appreciably shrink when subjected to temperatures up to near the polymer glass transition temperature. This terminology is of a general nature; that is, "crystalline" fiber as referred to herein is not always fully crystalline and "amorphous" fiber is not always fully amorphous. Rather, the as-spun fiber is considered amorphous fiber and has a relatively small degree of crystallinity based on the temperatures and treatments it has been exposed to; while crystalline fiber has a relatively larger degree of crystallinity based on being heat-treated around or above the glass transition temperature of the polymer. Also, for completeness, there is a second route to crystallizing the fiber; the fiber can be "crystallized" via chemical means using certain dye carriers, with or without dye.

Poly(m-phenylene isophthalamide), (MPD-I) and other meta-aramids may be polymerized by conventional processes. Polymer solutions formed from these processes may be rich in salt, salt-free or contain low amounts of salt. Polymer solutions described as having low amounts of salt are those solutions that contain less than 3% by weight salt. Salt content in the spinning solution generally results from the neutralization of by-product acid formed in the polymerization reaction; but salt may also be added to an otherwise salt-free polymer solution to provide the salt concentration necessary for the present process.

Salts that may be used in the present process include chlorides or bromides having cations selected from the group consisting of calcium, lithium, magnesium or aluminum. Calcium chloride or lithium chloride salts are preferred. The salt may be added as the chloride or bromide or produced from the neutralization of by-product acid from the polymerization of the aramid by adding to the polymerization solution oxides or hydroxides of calcium, lithium, magnesium or aluminum. The desired salt concentration may also be achieved by the addition of the halide to a neutralized solution to increase the salt content resulting from neutralization to that desired for spinning. It is possible to use a mixture of salts in the present invention.

The solvent is selected from the group consisting of those solvents which also function as a proton acceptors, for example dimethylforamide (DMF), dimethylacetamide (DMAc), N-methyl-2-pyrrolidone (NMP), and the like. Dimethyl sulfoxide (DMSO) may also be used as a solvent.

The present invention relates to a process for the production of fibers made of aramids containing at least 25 mole % (with respect to the polymer) of the recurring structural unit having the following formula, $$[—CO—R^1—CO—NH—R^2—NH—] \quad (I)$$

The $R^1$, $R^2$, or both, in one molecule can have one and the same meaning, but they can also differ in a molecule within the scope of the definition given.

If $R^1$, $R^2$, or both, stand for any bivalent aromatic radicals whose valence bonds are in the meta-position or in a comparable angled position with respect to each other, then these are mononuclear or polynuclear aromatic hydrocarbon radicals or else heterocyclic-aromatic radicals which can be mononuclear or polynuclear. In the case of heterocyclic-aromatic radicals, these especially have one or two oxygen, nitrogen or sulphur atoms in the aromatic nucleus.

Polynuclear aromatic radicals can be condensed with each other or else be linked to each other via C—C bonds or via bridge groups such as, for instance, —O—, —$CH_2$—, —S—, —CO— or $SO_2$—.

Examples of polynuclear aromatic radicals whose valence bonds are in the meta-position or in a comparable angled position with respect to each other are 1,6-naphthylene, 2,7-naphthylene or 3,4'-biphenyldiyl. A preferred example of a mononuclear aromatic radical of this type is 1,3-phenylene.

In particular it is preferred that the directly spinnable polymer solution is produced which, as the fiber-forming substance, contains polymers with at least 25 mole % (with respect to the polymer) of the above-defined recurring structural unit having Formula I. The directly spinnable polymer solution is produced by reacting dimes having Formula II with dicarboxylic acid dichlorides having Formula III in a solvent:

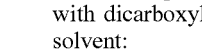

$$H_2N—R^2—NH_2 \quad (II)$$

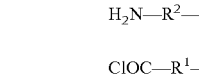

$$ClOC—R^1—COCl \quad (III)$$

The preferred meta-aramid polymer is MPD-I or co-polymers containing at least 25 mole % (with respect to the polymer) MPD-I.

Although numerous combinations of salts and solvents may be successfully used in the polymer spin solutions of the process of the present invention, the combination of calcium chloride and DMAc is most preferred.

In current art methods, a meta-aramid polymer solution containing a salt is extruded, at an elevated temperature, into a fiber via a high speed dry spinning process. The extruded fiber is sent downward through a column having a gaseous medium, the gaseous medium also at an elevated temperature, to evaporate a portion of the solvent. Without being bound by any limitation of theory of operation, it is believed that although it may be possible to extract all of the solvent in dry spinning, generally for meta-aramids this is not possible due to a chemical complex that forms between the solvent and the salt, and subsequent processing steps are required to remove this solvent.

The fiber exits from the bottom of the column and is then quenched in an aqueous solution having some solvent and salt content. The quenching solution reduces the temperature of the filaments and further develops the polymer-rich phase at the surface of the filaments.

After satisfactory and adequate quenching, the fiber will have a thin, semi-flexible, permeable, polymer-rich outer shell and a liquid or gel inner portion that is less rich in polymer and more rich in solvent, as illustrated in FIG. 1. The fiber 100, which for example can be extruded from a meta-aramid polymer solution, can develop a permeable outer shell 102 (not drawn to scale) and inner portion 104. Both outer shell 102 and inner portion 104 have relatively the same chemical constituents, though because of its direct contact with the hot gaseous medium and quenching, outer shell 102 may have less solvent than inner portion 104. Fiber 100 develops outer shell 102 and inner portion 104 due, in part, to the rapid movement of the fiber though the various processing conditions of spinning and solvent extraction; the fiber does not have time to reach an equilibrium state.

At this point, if the fiber is immediately subjected to a high speed drawing process, which may stretch the length of fiber many times its unit length to a desired diameter, the individual filaments have a high tendency to break. In order to prevent this, in current practice the fiber, still wet from the quenching process, is set aside in tubs for a period of time, which may be from several hours to several days. The fiber is then removed from the tubs and is simultaneously aqueously washed to remove solvent and drawn to the desired degree on a series of rolls in a number of aqueous baths.

The need to set aside the wet extruded fiber for a period of time in order to prepare the fiber for drawing effectively transforms the high speed dry spinning process from a continuous process into a batch process. Thus, the intended benefits of a high speed dry spinning process for meta-aramid fibers, e.g. higher throughput and reduced environmental impact, are not satisfactorily obtained in the current art.

The present process may be used as a high speed, dry spinning, continuous process to make a fiber from a meta-aramid polymer solution. In one embodiment, the polymer solution comprises 16 to 20 weight percent meta-aramid polymer; however, the exact useful polymer concentration is determined by having a suitable solution viscosity for spinning fibers. When the polymer is poly(metaphenylene diamine) the solution has an upper limit of about 20 weight percent, the combination of salt and polymer creating a solution having such a high viscosity that it is difficult to spin into fibers. A polymer concentration of less than about 16 weight percent is thought to not provide adequate solution viscosity to make useful fibers. In some embodiments the polymer solution comprises 3 to 10 weight percent salt; below 3 weight percent it is difficult to achieve a stable polymer solution and above 10 weight percent the solution viscosity becomes difficult to spin into fibers. In a preferred embodiment, the polymer solution comprises approximately 19 wt-% meta-aramid solids, approximately 70 wt-% DMAc solvent and 8 wt-% calcium chloride salt.

Figure 3:
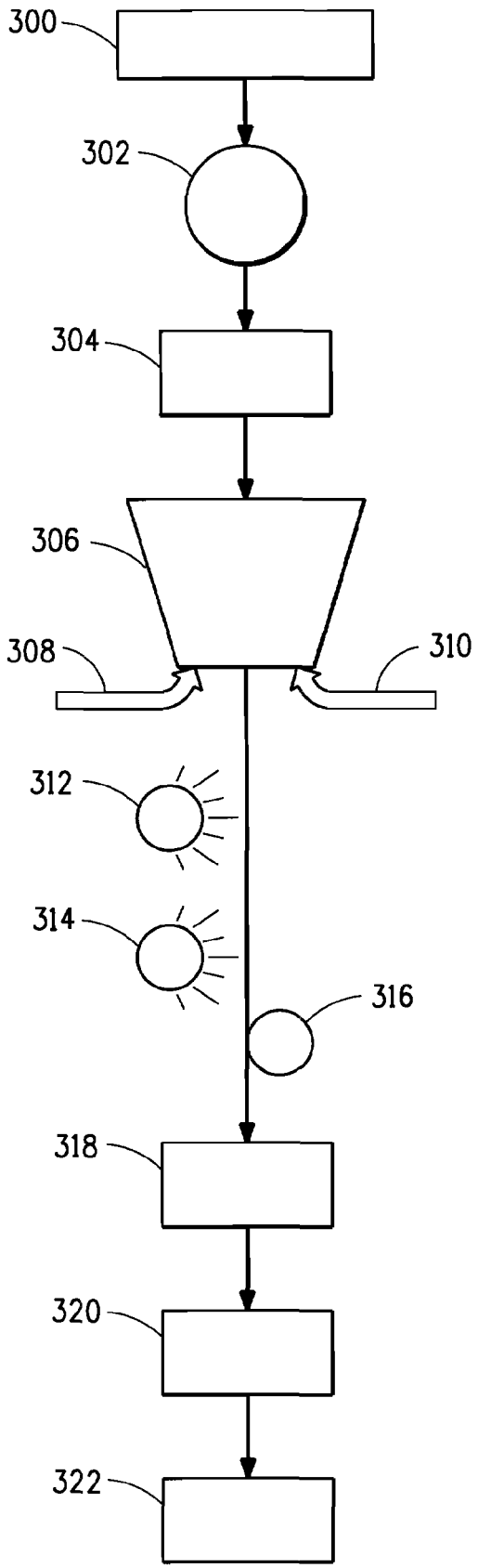
FIG. 3 shows a diagram of the process steps and techniques that may be used in the practice of the invention.

An example of a continuous process is shown in the diagram of FIG. 3. The polymer spinning solution is pumped from a polymerizer 300 by a feed pump 302 through a filter 304 and into and through a spinneret 304 to produce a fiber. The polymer solution, generally at a temperature in excess of 100° C. and in some preferred embodiments at a temperature range of 110° to 140° C., is typically spun through a multihole spinneret 304 into the top of chamber 306, forming streams of polymer solution that are coagulated into individual filaments, the collection of individual filaments forming a bundle of filaments. Chamber 306 is typically a hollow column with a hot, gaseous medium pumped continuously through. The hot, gaseous medium evaporates a portion of the solvent out of the fiber, generally at least 25 weight percent and preferably at least 50 weight percent of the initial solvent content of the fiber exiting the spinneret.

Although there may be several types of gases used, nitrogen gas, represented by gaseous inlet flows 308 and 310, is usually the most prevalent. Gaseous inlet flows 308 and 310 are typically above about 250 degrees Centigrade, and in some preferred embodiments the gas in the chamber is around 300 degrees Centigrade or greater. After exiting the chamber 306, the fiber or bundle of filaments is then immediately directed to a quenching step wherein the fiber or bundle of filaments is contacted by a quenching solution 312 having concentrations of solvent and salt. In some preferred embodiments, the solution has a salt concentration of from 0.5 to 10 percent salt and 2 to 20 percent by weight solvent. The temperature of the quenching solution is, generally, considerably less than the temperature of the fiber exiting from the column 306. In some preferred embodiments, the temperature of the quenching solution is 1 to 15 degrees Centigrade. In some preferred embodiments, the speed of the filaments in the quench step is at least 150 yards per minute.

The fiber or bundle of filaments is then immediately directed to a conditioning step where the fiber is conditioned prior to the subsequent drawing step 316 to prevent breakage of the individual filaments in this continuous process. Without being bound by any theory or principal of operation, it is believed that the additional conditioning step plasticizes the bundle of filaments allowing the filaments to be drawn and stretched without significant breakage of the individual filaments. Thus, in this inventive process, the fiber is then subjected to a conditioning solution, most often by spraying the solution onto the continuously moving fiber.

The conditioning solution preferably contains concentrations of solvent and salt at an elevated temperature. In particular, the conditioning solution has a higher concentration of solvent than the quenching solution, and has a higher temperature than the quench solution temperature. One preferred conditioning solution comprises solvent present in the aqueous conditioning solution at a weight percentage, based on total weight of the aqueous conditioning solution of from 5% to 40%, and salt present in the aqueous conditioning solution at a weight percentage, based on total weight of the aqueous conditioning solution of from 1% to 10% of solvent and salt. In some preferred embodiments, the conditioning has a temperature of from 30 to 100 degrees Centigrade.

Without being bound by any particular theory of operation, it is believed that the conditioning solution plasticizes the fiber in preparation for the upcoming drawing step. The conditioning solution acts to stabilize or equalize the concentration of solvent in the filament bundle, which may be variable across the filaments due to non-uniformities in the solvent removal and quenching stages. The conditioning solution is also believed to plasticize the outer shell of the individual filaments, as well as increasing the solvent content in the individual filaments, helping to equalizing the filament physical properties across the diameter of the individual filaments. To prevent the solvent from dissolving the fiber and turning the fiber back into a liquid polymer solution, the concentration of solvent in the conditioning solution should be maintained at a level such that the fiber is in a plasticized state but does not turn into a liquid state. The above concentrations of solvent and salt in an aqueous solution have been shown to maintain the fiber in a plasticized state sufficient for drawing. The composition and temperature of the conditioning solution is such that it rapidly plasticizes the filaments in the filament bundle, requiring only a few seconds of contact time. In one preferred embodiment, the fiber is contacted with the aqueous conditioning solution in total for the entire fiber manufacturing process for less than 2 minutes. It is believed that the conditioning solution is so effective it needs to only contact the filament bundle for as little as a total of five seconds throughout the entire process at high speeds.

Although there may be several ways in which to apply the conditioning solution to the fibers, a preferred method is to spray the conditioning solution onto the fibers to maintain the continuity of the process and avoid undue stress on the plasticized filaments. In a preferred process, this conditioning step is achieved by spraying the filament bundle with the conditioning solution while the filament bundle is spirally wrapped multiple times around one or more pair(s) of rolls operating at essentially the same rotational speed, although other methods of contacting the filament bundle with liquid are possible. In some embodiments the conditioning solution is in contact with the filament bundle during the conditioning step from about 5 to 30 seconds. In some preferred embodiments the conditioning solution is contact with the filament bundle during the conditioning step from about 10 to 25 seconds.

After the fiber is conditioned by conditioning solution 314, the fiber is then immediately directed to a drawing step where the fiber is drawn to improve the mechanical properties of the fiber, again in a continuous process, in a drawing step 316.

The drawing can be accomplished in various ways. In one embodiment the filament bundle serpentine wraps multiple sets of rolls operating at progressively higher rotational speeds. By "serpentine wraps" it is meant the filament bundle wraps each roll with a single wrap, contacting the roll (or having a wrap angle on the roll surface) generally in excess of 180 degrees. There are several variables in all drawing processes on rolls, and the actual wrap angle, the number of rolls, and their relative speeds are highly dependent on the amount of draw desired and on the relative friction characteristics between the fiber bundle and the roll surface. In some preferred embodiments, it is desired to have these rolls operating in groups of three; that is, the filament bundle serpentinely wraps around three rolls, all operating at the same speed, and then the filament bundle serpentinely wraps around a second set of three rolls all operating at the same second speed, with this second speed being higher than the speed of the first set of three rolls.

For the purposes herein in relation to the serpentine drawing process, the combination of a first set of rolls operating at one speed with the second set of rolls operating at a higher second speed are considered one draw stage. In a preferred embodiment of this particular process, only two sets of rolls are used and the speed between the two sets of rolls is controlled such that the tension on the filament bundle between the two sets of rolls is maintained at a tension of 2 grams per denier or less with the lower limit being about 0.25 grams per denier. However, if desired, additional sets of rolls can be added as needed to additionally draw the fiber, but with each additional draw stage the potential for filament breakage increases. It is also preferred to keep the filament bundle wet during the drawing step by spraying the filament bundle generally throughout the drawing stage with the same aqueous solution used in the conditioning step. In some preferred embodiments, the conditioning solution is in contact with the filament bundle during the drawing step less time than in the conditioning step. In some embodiments the conditioning solution is in contact with the filament bundle during the drawing step for 1 to 20 seconds.

In one preferred embodiment, the drawing is accomplished using a single drawing stage using two pairs of rolls spirally wrapped by the filament bundle. In this embodiment, the filament bundle spirally wraps multiple times around a pair of spaced-apart rolls, both operating at the same speed. The filament bundle is then directed to a second pair of spaced-apart rolls; it then spirally wraps this second pair of spaced-apart rolls multiple times. Both of the rolls in the second pair are operating at the same speed, and this speed is higher that the speed of the first set of rolls. The draw on the filament bundle then occurs between the two pairs of rolls. As in the serpentine drawing process, the contact between the filament bundle and the roll surface provides the friction to isolate the filament bundle and draw the filaments between the two pairs of rolls. Preferably, the speeds of the two pairs of rolls are adjusted to maintain the tension on the filament bundle between the two pairs of rolls at 2 grams per denier or less with the lower limit being about 0.25 grams per denier. It is also preferred to keep the filament bundle wet during the drawing step by spraying the filament bundle with the same aqueous solution used in the conditioning step in each draw stage, with the sprays preferably occurring between the two rolls that make up each pair.

In another embodiment, the drawing is accomplished using a plurality of drawing stages wherein the residence time between each draw stage is at least one second. In a preferred operation of this embodiment, a first draw stage is operated using two pairs of spirally wrapped rolls, each pair operating at a different speed, with the second pair having a higher rotational speed than the first pair, as just described. The filament bundle leaves this second pair of rolls and then is directed to a third pair of spirally wrapped rolls. The second pair of rolls and the third pair of rolls form a second draw stage. The filament bundle then leaves the third pair of rolls and is directed to a fourth pair of spirally wrapped rolls. The third and fourth pairs of rolls form a third draw stage. In this arrangement, the speed of the fourth pair of rolls is operating at a higher rotational speed than the second pair of rolls. The residence time of one second between the draw stages is achieved by matching the speed of the second pair of rolls of the first drawing stage with the third pair of rolls, which is in the second drawing stage, such that there is no substantial draw on the filament bundle between the two drawing stages, but there is draw between the second and third stages (the third and fourth pairs of spirally wrapped rolls) The residence time between the first and third drawing stages can then be changed based on the number of wraps on the third pair of rolls.

The draw occurs between the two pairs of rolls, and preferably the tension between the two pairs of rolls in both the first stage and the third stage each is maintained at 2 grams per denier or less with the lower limit being about 0.25 grams per denier. In one embodiment the first stage has more draw than the third stage. As before, it is also preferred to keep the filament bundle wet throughout the drawing step by spraying the filament bundle with the same aqueous solution used in the conditioning step in each draw stage, with the sprays preferably occurring between the two rolls that make up each pair. In one preferred process, only two draw stages are utilized; however, if desired, additional draw stages can be added as needed to additionally draw the fiber, operating these additional draw stages in the same manner; but with each additional draw stage the potential for filament breakage increases.

In a preferred embodiment, the filaments are drawn at least three times their linear length in the drawing step. The continuous process has a speed after the drawing step of at lest 450 yards per minute.

After drawing, the filament bundle is then immediately directed to a washing step 318 to remove solvent and salt from the filament bundle. Typically the wash liquid in this step is water, although if desired other liquids may be used. In a preferred process, this washing is achieved by spraying the filament bundle with water while the filament bundle is spirally wrapped multiple times around one or more pair(s) of rolls operating at essentially the same rotational speed, although other methods of contacting the filament bundle with liquid are possible.

After washing, the fiber is then immediately directed to a drying step 320 and, optionally if desired after drying, immediately directed to a heat treating step 322. In one embodiment the drying is accomplished by passing the fiber over one or more dryer drums, heated rolls, or both, operating at a temperature of from 150 to 250 degrees C. to drive water from the filaments, while the heat treating of the fiber occurs by subsequently passing the dry fiber over one or more hot rolls, typically in a range near to or above the glass transition temperature of the polymer, generally about 260 to 390 degrees C. for meta-aramids. A higher heat treating temperature increases the degree of structure on a molecular level in the fiber. The time at that temperature can also impact this molecular structure formation.

While described as two separate steps, it is conceivable the steps can be combined by gradually contacting the filaments with more and more heat to first dry and then heat treat the fiber. Further, if desired, the fiber can be drawn during either drying or heat treating, but in one preferred embodiment of this process, little or no draw is intentionally imparted to the filament bundle in either the drying or heat treating step. However, in some other embodiments the tension on the filament bundle in these processes can be in excess of 0.25 grams per denier up to about 1 gram per denier. In some other embodiments the tension on the filament bundle can be up to 2 grams per denier, which is considered the upper practical limit for making useful filaments.

Heat treating is preferable for some meta-aramid fibers because when using dry spinning to produce a fiber from a meta-aramid polymer solution, the resulting as-spun fiber typically has a low level of crystallinity, meaning the fiber has a high level of thermal shrinkage. Although this process may reduce the level of thermal shrinkage, the fiber becomes less accepting of dyes; or in other words, the fiber is unable to take on a coloration dye when compared to an uncrystallized as-spun fiber.

In another embodiment, the present invention provides a process by which meta-aramid polymer solutions rich in salt may be dry spun, conditioned, drawn, washed, dried, and heat treated, all in a continuous non-stop process, to achieve a fiber having both useful mechanical properties and is more easily colored to darker shades using dyes. Such a meta-aramid fiber has a thermal shrinkage after ½ hour at 285 degrees C. of 0.4% or less and an "L" value of less than 50. The preferred crystallized meta-aramid fiber polymer is poly(metaphenylene isophthamide).

The color of fibers and fabrics can be measured using a spectrophotometer also called a colorimeter, which provides three scale values "L", "a", and "b" representing various characteristics of the color of the item measured. On the color scale, lower "L" values generally indicate a darker color, with the color white having a value of about 100 and black having a color of about 0. Both as-spun (amorphous) and heat-treated (crystallized) meta-aramid fiber has a white color that when measured using a colorimeter has a "L" value generally above about 85. By operating the continuous dry spinning process described herein, including gentle heat-treating of the fiber at the low temperatures, a crystallized meta-aramid fiber can be produced that when dyed has a "L" value that is at least 40 units lower than the fiber before coloration. This means the "L" value of the fiber after coloration is about 45 or less.

The preferred dye used to measure this "L" value difference is a red dye, specifically a Basacryl Red GL dye available from BASF Wyandotte Corp., Charlotte, N.C. In one embodiment, the solution used to color the fibers is made in the following manner. 2 grams of the Basacryl Red GL dye is mixed with 2 ml of 99.7% acetic acid. 200 ml of hot water (150+/−10 degrees F.) is then added to the acetic acid while stirring to form a dye concentrate. 50 ml of this dye concentrate and 16 ml of C-45 (Aryl Ether) dye carrier (available from Stockhausen, Greensboro, N.C.) are then mixed together in a beaker. Additional hot water (150+/−10 degrees F.) is then added to make the volume of the solution 450 ml. The pH of the solution is then adjusted to 2.8 to 3.2 by adding a 10% tetrasodium pyrophosphate (also referred to as sodium pyrophosphate). The dye solution is then poured into the dye cavity of an Ahiba Multiprecise TC Dyer. An additional 50 ml of hot water is then used to rinse the beaker and is added to the dye cavity.

This thermally stable fiber that still accepts significant color can be made using the dry spinning process of this invention. In this embodiment, the heat-treated but colorable fiber is made by drying the fiber at a temperature of up to and including 250 degrees Centigrade, preferably between 150 and 250 degrees Centigrade, followed by heat treating the fiber at higher temperatures of up to and including 300 degrees Centigrade, preferably from 260 to 300 degrees Centigrade, for 0.5 to 5 seconds. In a preferred process, the fiber is drawn on rolls having a surface temperature in this range and wherein the speeds of the rolls are controlled such that the speed ratio between the rolls is from 1.1 to 1.5. In one embodiment, the resulting fiber is accepting of dye to a greater extent than prior art, heat stabilized meta-aramid fibers, picking in excess of 50% of the dye from the aqueous dyeing solution. In one embodiment, the dye is concentrated near the surface of the fiber.

While this process is useful for the dry-spinning of meta-aramid fiber, it is believed other fibers can be dry-spun from other polymers using any number of solvents in a similar manner; that is, by spinning filaments from a polymer solution into a hot gaseous atmosphere to remove a large portion of the solvent from the filaments, immediately quenching those filaments with a solvent containing quenching solution, followed by immediately conditioning of the filaments by contacting the filaments with a conditioning solution having a higher concentration of solvent than the quench solution, followed by immediately drawing, washing, drying, and optionally heat treating the filaments, respectively, in order.

Test Methods

Color Measurement.

The system used for measuring color is a 1976 CIELAB color scale (L-a-b system developed by the Commission Internationale de l'Eclairage). In the CIE "L-a-b" system, color is viewed as point in three dimensional space. The "L" value is the lightness coordinate with high values being the lightest, the "a" value is the red/green coordinate with "+a" indicating red hue and "−a" indicating green hue and the "b" value is the yellow/blue coordinate with "+b" indicating yellow hue and "−b" indicating blue hue. A spectrophotometer using the industry standard of 10-degree observer and D65 illuminant was used to measure the color of fibers in the examples.

Fiber Shrinkage.

To test for fiber shrinkage at elevated temperatures, the two ends of a sample of multi-filament yarn to be tested are tied together with a tight knot such that the total interior length of the loop is approximately 1 meter in length. The loop is then tensioned until taut and the doubled length of the loop measured to the nearest 0.1 cm. The loop of yarn is then hung in an oven for 30 minutes at 285 degree Centigrade. The loop of yarn is then allowed to cool, it is re-tensioned and the doubled length is re-measured. Percent shrinkage is then calculated from the change in the linear length of the loop.

The following examples are provided to show various processing steps that may be used for producing fibers using the present inventive process.

Example 1

This example illustrates the high-speed continuous production of a multi-filament meta-aramid continuous fiber via dry spinning a solvent rich poly(metaphenylene isophthalamide) (MPD-I)polymer into a multifilament fiber yarn using a single step drawing stage.

A MPD-I polymer solution consisting of 19 wt-% MPD-I solids, 70 wt-% DMAc solvent and 8 wt-% calcium chloride salt, was extruded at 17 pounds per hour of MPD-I on a dry-basis through 600 small orifice-shaped capillaries of 0.01 inches in diameter into a spin cell which was a long heated tube with flowing hot inert nitrogen gas at 300° C. This polymer extrusion into a dry gas in a heated tube removed approximately 50% of the solvent from the polymer solution via flashing it from the streams of extruded polymer.

At the end of the spin cell, spun fiber filaments, containing MPD-I polymer, salt & solvent, were quenched at 280 yards per minute with a water-based liquor to form a skin on the fiber surface. The temperature of the quench liquor was 10° C., and it contained 10 wt-% solvent and 1 wt-% salt. After quenching, the fiber, composed of MPD-I polymer, solvent, salt and water with a surface liquor proceeded through two additional and successive applications of quench liquor supplied at 10° C.

After quenching, the quenched multifilament fiber immediately proceeded to a conditioning step, where the composition of the fiber was conditioned in preparation for drawing by applying 65° C. liquid (25 wt-% solvent, 5 wt-% salt, balance water) via spraying onto the fiber surface as the fiber passed over rolls.

After twelve seconds of conditioning, the fiber with surface liquid immediately proceeded to a drawing step of rolls turning at a faster speeds, drawing the wet fiber as it transitioned to rolls that turned at 3.85 times the speed of the rolls in conditioning. As the wet fiber went to the draw rolls at higher speed, 65° C. liquid (25 wt-% solvent, 5 wt-% salt, balance water) was sprayed onto the fiber surface as the fiber passed over the draw rolls. The speed of the draw rolls were set to draw the wet fiber an additional 3.85× as it passed over rolls at higher speeds (greater than 1,000 yards per minute), so as to obtain the finished 1,200 denier yarn. Three draw stages of draw rolls in a sequential arrangement were used however only one stage imparted draw to the wet fiber. The first stage imparted a 3.85× total draw, and the second and third stages imparted no additional draw, operating the same speed as the first stage. The yarn speed exiting the draw step was in excess of 1,000 yards per minute.

After drawing, the wet fiber composed of MPD-I polymer, solvent, salt and water immediately proceeded to a washing process, where 90° C. water was sprayed on the drawn fiber surface as the fiber passed over rolls to wash and remove residual solvent and salt from the filaments. After being washed for four seconds, the washed wet fiber exited the washing process and immediately proceeded to the drying step. Prior to the drying step, excess wash water was removed from the washed fiber with a pin guide contact surface.

In the drying step, the wet fiber was contacted with a roll surface at 250° C. to remove remaining surface liquid (water) and to dry the fiber. The fiber was dried for three seconds in excess of 1,000 ypm to dry the fiber. The dried fiber then immediately proceeded to the heat treating step. The heat treating of the fiber was done by subsequently passing the dry fiber over two hot rolls at 375° C., above the glass transition temperature of the polymer. This heat treating of the fiber at 375° C. for three seconds enhanced the molecular structure in the filament, thereby increasing fiber strength.

After the heat treating step, the multi-filament fiber was then cooled by passing the hot fiber over room-temperature rolls, a 1 wt-% antifriction textile finish was applied, and the yarn was wound onto a tube.

Yarn samples taken from a bobbin of wound yarn were subsequently tested for physical properties with these results:

Filaments: 600 Denier: 1,148
Tenacity 4.87 grams per denier,
Break Strength 12.3 $lb_{Force}$
Elongation at Break 28.5
Shrinkage aft ½ hr at 285° C. in Air: 1.8%

Example 2

This example illustrates the high-speed continuous production of a multi-filament meta-aramid continuous fiber via dry spinning a solvent rich meta-phenyldiamine (MPD) polymer into a multifilament fiber yarn using multiple step drawing stages. The process of Example 1 was repeated, except that the 19 pounds per hour of MPD-I on a dry-basis was extruded and the filaments were quenched at 290 yards per minute.

The speed of the draw rolls were set to draw the wet fiber an additional 3.7× as it passed over rolls at higher speeds so as to obtain the finished 1,500 denier yarn. Three draw stages of draw rolls in a sequential arrangement were used to draw the wet fiber in three successive steps. The first stage imparted a 2.6× draw, the second stage provided a 1.3× draw, and the third stage provided a 1.1× draw. The yarn speed exiting the draw step was in excess of 1,000 yards per minute.

After drawing, the wet fiber composed of MPD-I polymer, solvent, salt and water immediately proceeded to a washing process, where 90° C. water was sprayed on the drawn fiber surface as the fiber passed over rolls to wash and remove residual solvent and salt from the filaments. After being washed for four seconds, the washed wet fiber exited the washing process and immediately proceeded to the drying step. Prior to the drying step, the excess wash water was removed from the washed fiber with a pin guide contact surface.

In the drying step, the wet fiber was contacted with a roll surface at 225° C. to remove remaining surface liquid (water) and to dry the fiber. The fiber was dried for three seconds in excess of 1,000 ypm to dry the fiber. The dried fiber then immediately proceeded to the heat treating step. The heat treating of the fiber was done by subsequently passing the dry fiber over two hot rolls at 360° C., above the glass transition temperature of the polymer. This heat treating of the fiber at 360° C. for one second enhanced the molecular structure in the filament, thereby increasing fiber strength.

After the heat treating step, the multi-filament fiber was then cooled by passing the hot fiber over room-temperature rolls, a 1 wt-% anti-friction finish was applied, and the yarn was wound onto a tube.

Yarn samples taken from a bobbin of wound yarn were subsequently tested for physical properties with these results:
Filaments: 600
Denier: 1,524
Tenacity 4.37 grams per denier,
Break Strength 15.2 $lb_{Force}$
Elongation at Break 27.9

Example 3

This example illustrates the high-speed continuous production of a multi-filament meta-aramid continuous fiber via dry spinning a solvent rich meta-phenylene isophthamide (MPD-I) polymer into a multifilament fiber yarn that has the features of good coloration and low shrinkage. The process of Example 1 was repeated, except as follows.

After quenching, the quenched multifilament fiber immediately proceeded to a conditioning step, where the composition of the fiber was conditioned in preparation for drawing by applying 90° C. liquid (25 wt-% solvent, 5 wt-% salt, balance water) via spraying onto the fiber surface as the fiber passed over rolls.

After twelve seconds of conditioning, the fiber with surface liquid immediately proceeded to a drawing step of rolls turning at faster speeds, drawing the wet fiber as it transitioned to rolls that turned at 3.9 times the speed of the rolls in conditioning. As the wet fiber went to the draw rolls at higher speed, 90° C. liquid (25 wt-% solvent, 5 wt-% salt, balance water) was sprayed onto the fiber surface as the fiber passed over the draw rolls. The speed of the draw rolls were set to draw the wet fiber an additional 3.9× as it passed over rolls at higher speeds (greater than 1,000 yards per minute), so as to obtain the finished 1,200 denier yarn. Three draw stages of draw rolls in a sequential arrangement were used however only one stage imparted draw to the wet fiber The first stage imparted a 3.9× total draw and the second and third stages imparted no additional draw, operating the same speed as the first stage The yarn speed exiting the draw step was in excess of 1,000 yards per minute.

After drawing, the wet fiber, composed of MPD polymer, solvent, salt and water, immediately proceeded to a washing process where 85° C. water was sprayed on the drawn fiber surface as the fiber passed over rolls to wash and remove residual solvent and salt from the filaments. After being washed for three seconds, the washed wet fiber exited the washing process and immediately proceeded to the drying step. Prior to the drying step, the excess surface liquor (wash water) was removed from the washed-fiber with a pin guide contact surface.

The fiber was then dried as in Example 1. The dried fiber then immediately proceeded to the heat treating step. The heat treating of the fiber was done by subsequently passing the dry fiber over two hot rolls at 280° C., above the glass transition temperature of the polymer. This heat treating of the fiber at 280° C. for three seconds enhanced the molecular structure in the filament, thereby increasing fiber strength.

After the heat treating step, the multi-filament fiber was then cooled by passing the hot fiber over room-temperature rolls, a 1 wt-% antifriction textile finish was applied, and the yarn was wound onto a tube.

Figure 4:
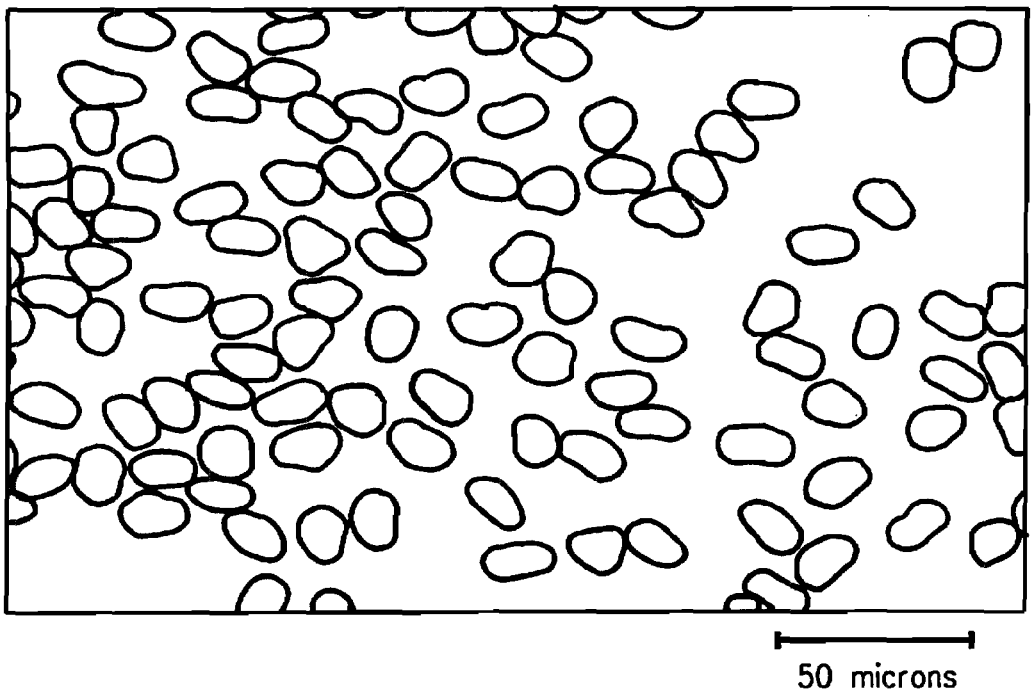
FIG. 4 is a scanned image of a micrograph showing cross-sections of the filaments in the yarn shows the red-dye to be concentrated near the surface of the fiber.

Yarn samples taken from a bobbin of wound yarn were subsequently tested for physical properties, and yarn samples taken from the bobbin of wound yarn were subsequently tested for dye pick-up by subjecting the yarn sample with red dye in an aqueous bath at 120° C. for 1 hour. The dyeability was evaluated by computing the red-dye picked-up by the fiber, plus measuring the L, A, and B color parameters of the sample after the dyeing process. Prior to dyeing, the yarn color was white with these color coordinate values: L: 88 A: −1.1 and B: 4.8. A higher percentage of dye pick-up indicates better coloration, a higher A color result indicates a more "red" yarn, and a lower L color result indicates a darker yarn, confirming the absorption of red dye into the fiber. FIG. 4 is a scanned image of a micrograph showing cross-sections of the filaments in the yarn shows the red-dye to be concentrated near the surface of the fiber.

Figure 5:
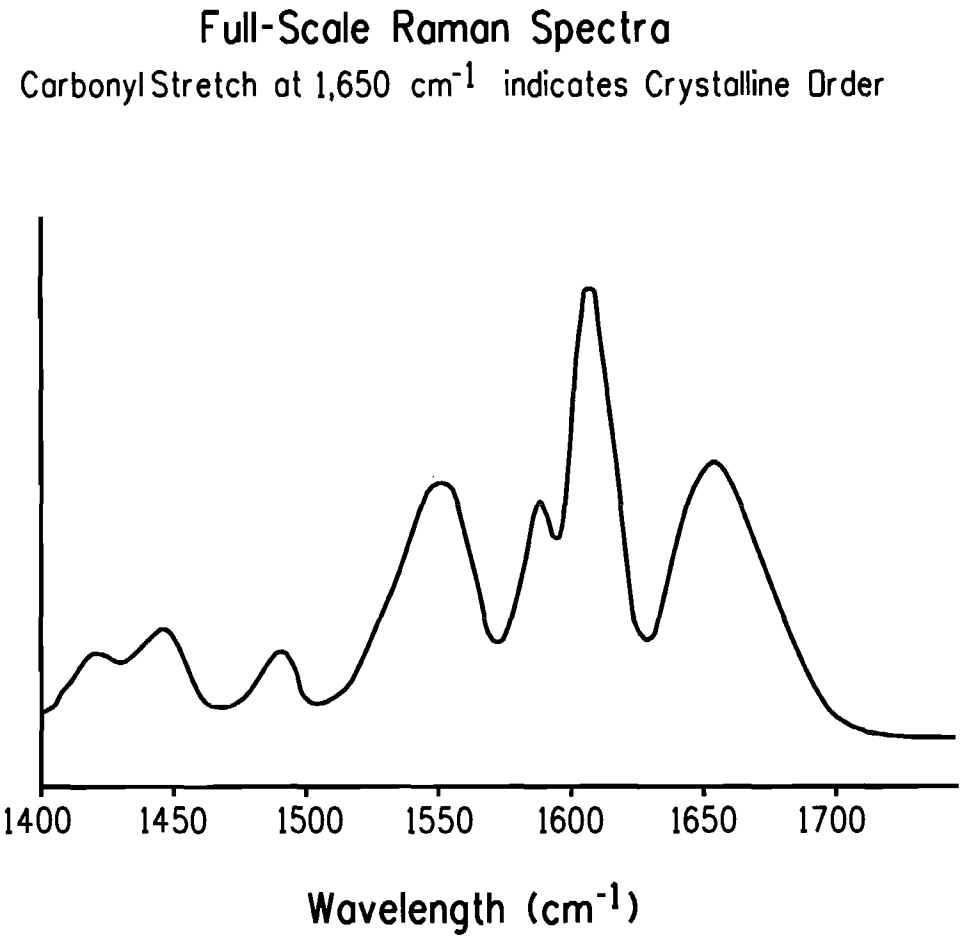
FIG. 5 is a Raman spectrograph which shows the yarn of FIG. 4 to be a meta-aramid with crystalline structure, an attribute of meta-aramid fibers with low shrinkage at elevated temperatures.

Testing was done on yarn from this bobbin to generate a Raman spectra response, shown in FIG. 5, which shows this yarn to be a meta-aramid with crystalline structure, an attribute of meta-aramid fibers with low shrinkage at elevated temperatures (285° C.). As shown in FIG. 5, the carbonyl stretch peak shown at a wavelength of approximately 1,650 $cm^{-1}$ indicates the presence of a crystalline structure within the tested yarn. Additional fibers were tested and were consistent with the Raman spectra of the yarn of FIG. 4.

The yarn exhibited the following characteristics:

Filaments: 600 Denier: 1,244

Tenacity 4.29 grams per denier,

Break Strength 11.6 $lb_{Force}$

Elongation at Break 25.5%

Shrinkage aft ½ hr at 285° C. in Air: 0.2%

Color Before Dyeing: L: 88 A: −1.1 B: 4.8

Red Dye Pick-up: 66%

Color After Dyeing: L: 42 A: 43.7 B: 1.8

Example 4

Example 3 was repeated except:
the wet draw ratio was 3.83×
the liquid in the condition step was 20 wt-% DMAc, 1 wt-% salt, balance water
the liquid in the draw step was 20 wt-% DMAc, 1 wt-% salt, balance water
the temperature of rolls in the heat treating step were: the $1^{st}$ hot roll was 360° C. and the $2^{nd}$ hot roll was 360° C.

The yarn exhibited the following characteristics:
Filaments: 600 Denier: 1,206
Tenacity 4.92 grams per denier,
Break Strength 13.1 $lb_{Force}$
Elongation at Break 26.2%
Shrinkage aft ½ hr at 285° C. in Air: 0.7%
Color Before Dyeing: L: 88 A: −1.1 B: 4.8
Red Dye Pick-up: 23%
Color After Dyeing: L: 57 A: 31.9 B: −0.4

Figure 6:
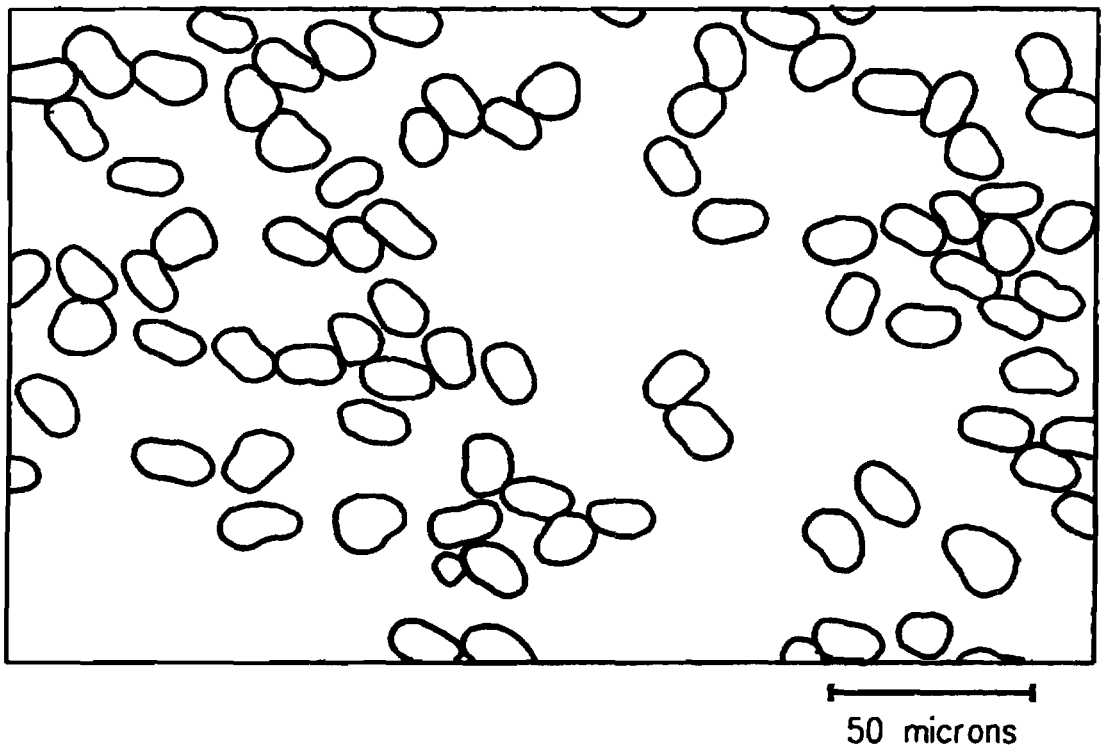
FIG. 6 is a scanned image of a micrograph showing cross-sections of the filaments in the yarn made using a modified process compared to the yarn shown in FIG. 4.

This sample had low shrinkage but had "poor" coloration in terms of low dye pick-up and low absorption of red dye, as indicated by the higher L value of 57 and the lower A color of 31.9. FIG. 6, a scanned image of a micrograph showing cross-sections of the filaments in the yarn, reveals relatively little red-dye in the fiber or at the surface of the fiber.

Example 5

Example 3 was repeated except:
the wet draw ratio was 2.78×
yarn speed was adjusted in the heat treating step to impart 1.4× draw to the yarn.

The yarn of exhibited the following characteristics:
Filaments: 600 Denier: 1,271
Tenacity 4.2 grams per denier,
Break Strength 11.6 $lb_{Force}$
Elongation at Break 22.9%
Shrinkage aft ½ hr at 285° C. in Air: 0.4%
Red Dye Pick-up: 86%
Color After Dyeing: L: 38 A: 45.5 B: 3.9

Figure 7:
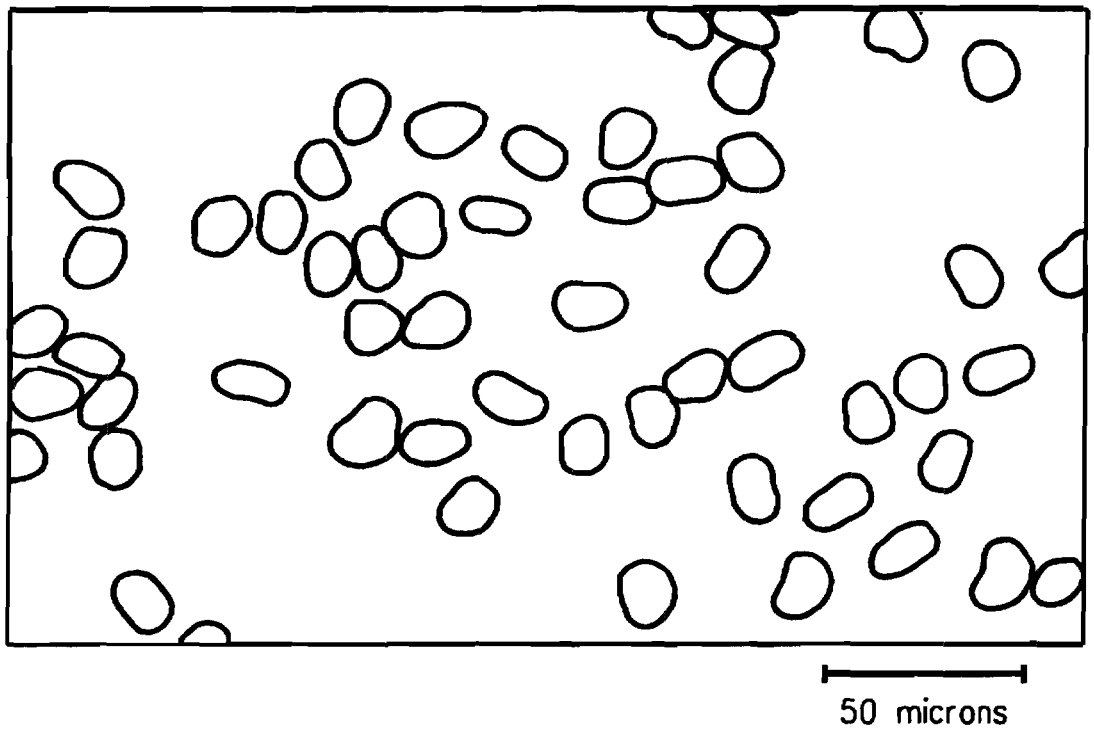
FIG. 7 is a scanned image of a micrograph showing cross-sections of the filaments in the yarn made using a modified process compared to the yarn shown in FIG. 4.

FIG. 7 is a scanned image of a micrograph showing cross-sections of the filaments in the yarn shows the red-dye to be concentrated near the surface of the fiber.

Figure 8:
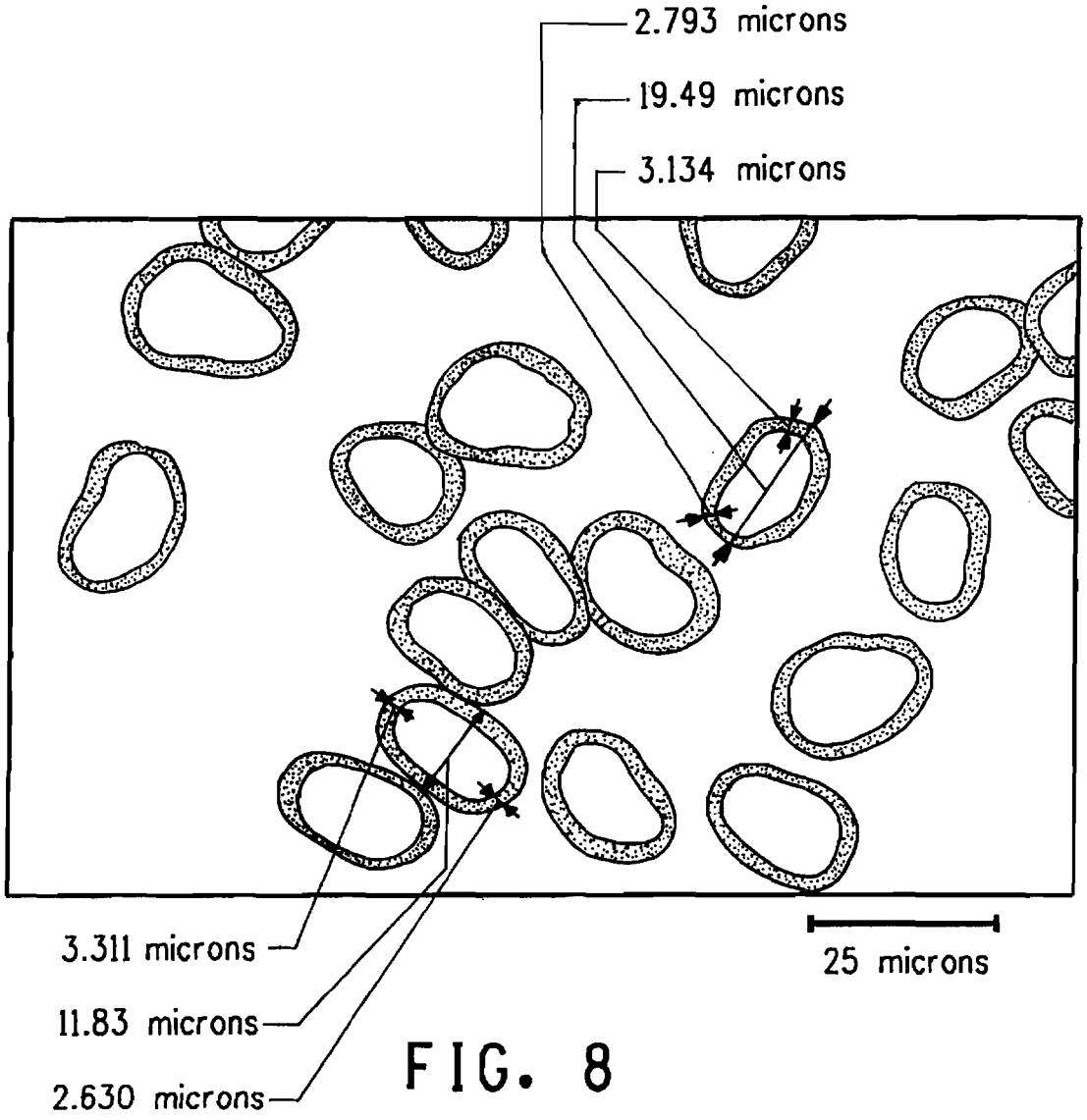
FIG. 8 is a scanned image of a micrograph showing cross-sections of the filaments in the yarn of FIG. 7 showing the red-dye to be concentrated near the surface of the fiber.

FIG. 8 is another scanned image of a micrograph showing cross-sections of the filaments in the yarn shows the red-dye to be concentrated near the surface of the fiber. The scale shown on FIG. 8 indicates the dye to be concentrated at the outer surface of the fiber.

Example 6

Example 3 was repeated except:
the wet draw ratio was 3.54×
yarn speed was adjusted in the heat treating step to impart 1.1× draw to the yarn.

Figure 9:
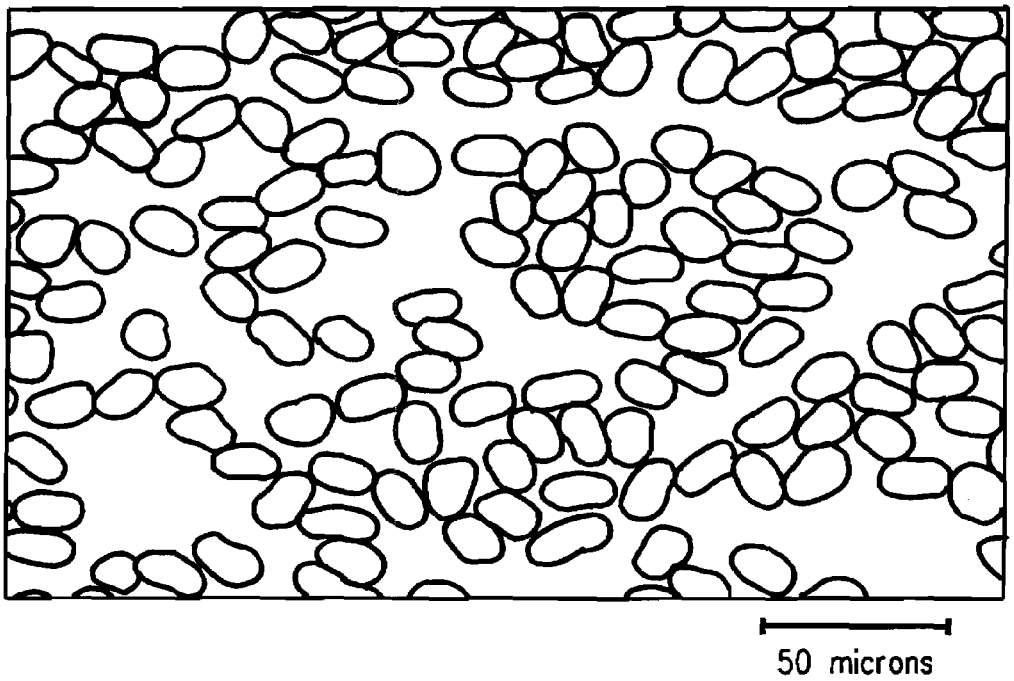
FIG. 9 is a scanned image of a micrograph showing cross-sections of the filaments in the yarn using a modified process compared to the yarn shown in FIG. 4.

FIG. 9 is a scanned image of a micrograph showing cross-sections of the filaments of this yarn. The yarn exhibited the following characteristics:
Filaments: 600 Denier: 1,267
Tenacity 4.2 grams per denier,
Break Strength 11.8 $lb_{Force}$
Elongation at Break 23.8%
Shrinkage aft ½ hr at 285° C. in Air: 0.2%
Red Dye Pick-up: 71%
Color After Dyeing: L: 41 A: 43.5 B: 1.6

Example 7

Example 3 was repeated except:
the wet draw ratio was 3.56×
the temperature of the rolls in the heat treating step were: $1^{st}$ hot roll was 290° C. and the $2^{nd}$ hot roll was 290° C. The yarn speed was adjusted in the heat treating step to impart 1.1× draw to the yarn.

Figure 10:
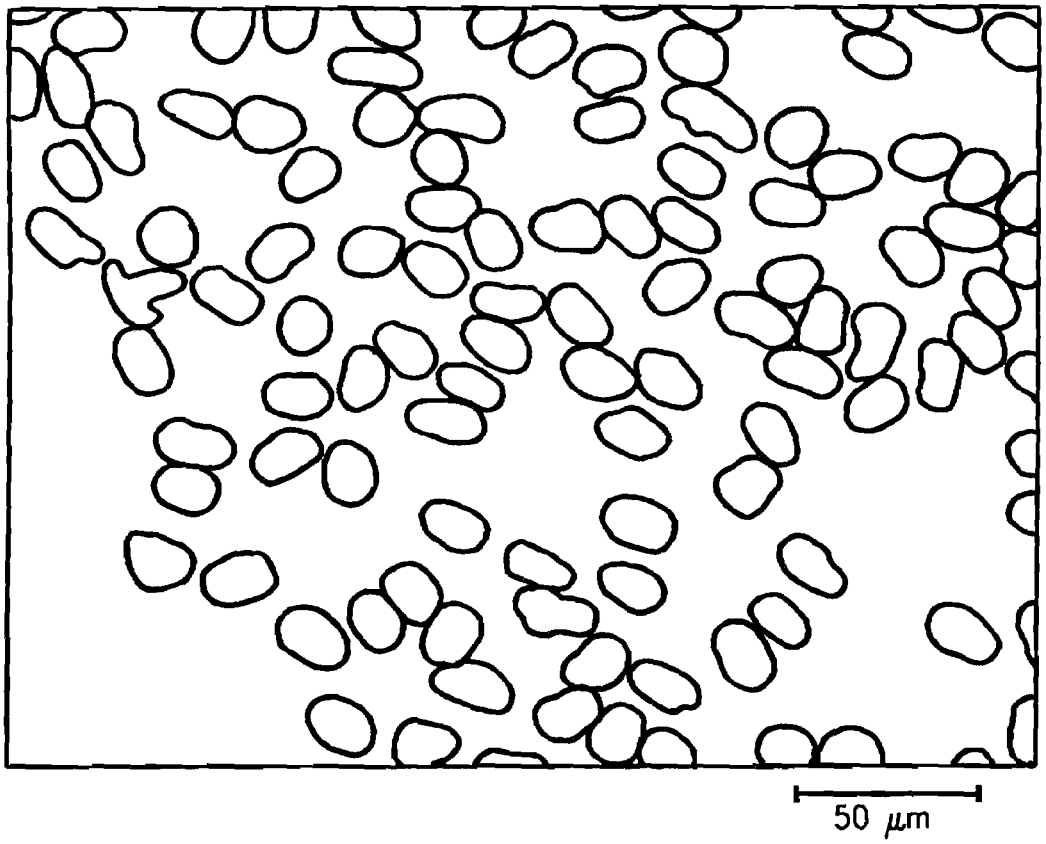
FIG. 10 is a scanned image of a micrograph showing cross-sections of the filaments in the yarn using a modified process compared to the yarn shown in FIG. 4.

FIG. 10 is a scanned image of a micrograph showing cross-sections of the filaments of this yarn. The yarn of exhibited the following characteristics:
Filaments: 600 Denier: 1,250
Tenacity 4.4 grams per denier,
Break Strength 12.1 $lb_{Force}$
Elongation at Break 24.3
Shrinkage aft ½ hr at 285° C. in Air: 0.7%
Red Dye Pick-up: 72%
Color After Dyeing: L: 40 A: 44.9 B: 2.2

Example 8

Example 3 was repeated except:
200 filaments were separated into a bundle in the spinning step
the wet draw ratio was 3.9×
the temperature of the rolls in the heat treating step were: $1^{st}$ hot roll was 270° C. and the $2^{nd}$ hot roll was 270° C. (below the glass transition temperature of the polymer).

Figure 11:
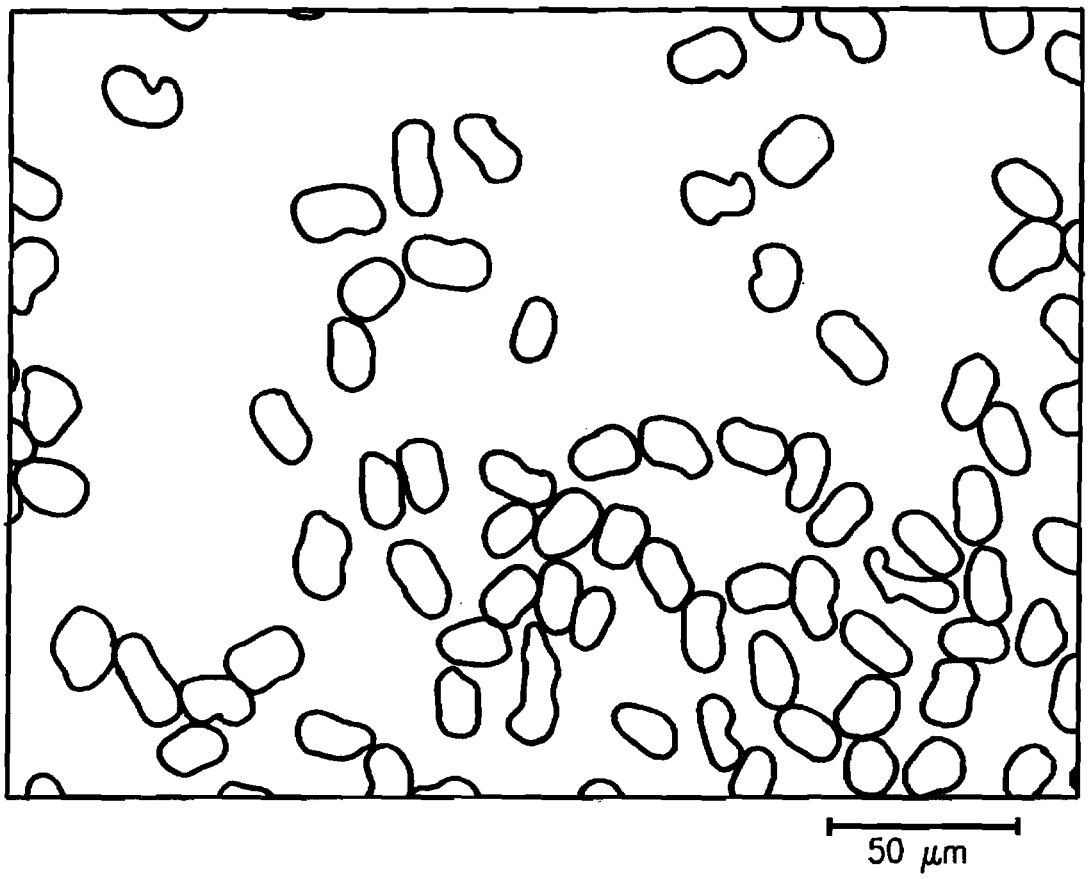
FIG. 11 is a scanned image of a micrograph showing cross-sections of the filaments in the yarn using a modified process compared to the yarn shown in FIG. 4.

FIG. 11 is a scanned image of a micrograph showing cross-sections of the filaments in the yarn The yarn exhibited the following characteristics:
Filaments: 200 Denier: 405
Tenacity 4.6 grams per denier,
Break Strength 4.1 $lb_{Force}$
Elongation at Break 22%
Shrinkage aft ½ hr at 285° C. in Air: 0.7%
Red Dye Pick-up: 82%
Color After Dyeing: L: 37 A: 45.6 B: 3.4

What is claimed:

1. A poly(metaphenylene isophthalamide) polymer fiber having a crystalline structure as represented by a carbonyl stretch peak at a wavelength of 1,650 $cm^{-1}$ in a Raman spectra response;
said fiber, before coloration with a dye, shrinks linearly 0.4 percent or less when exposed to 285 degrees Centigrade for 30 minutes; and
said fiber, after contact with an aqueous red dye solution for 1 hour at 120 degrees Centigrade, has an "L" value coloration of at least 40 units lower than the "L" value of the fiber before coloration.

2. The polymer fiber of claim 1, wherein the "L" value of the fiber after coloration is 45 or less.

* * * * *